US006202823B1

(12) United States Patent
Howard et al.

(10) Patent No.: US 6,202,823 B1
(45) Date of Patent: Mar. 20, 2001

(54) COIN STORAGE AND CHANGING MECHANISM

(75) Inventors: Christine Ruth Howard, Bridgeton; Robert A. Abt, Florissant; Gregory Glen Stettes, Pacific, all of MO (US)

(73) Assignee: Crane Co., Stamford, CT (US)

( * ) Notice: Subject to any disclaimer, the term of this patent is extended or adjusted under 35 U.S.C. 154(b) by 0 days.

(21) Appl. No.: 09/396,118

(22) Filed: Sep. 14, 1999

(51) Int. Cl.[7] ..... G07F 9/06
(52) U.S. Cl. ..... 194/350
(58) Field of Search ..... 194/217, 218, 194/350; 700/238; 340/825.35

(56) References Cited

U.S. PATENT DOCUMENTS 4,697,687 * 10/1987 Wilson ..... 194/350 X
5,884,745 * 3/1999 Kalis et al. ..... 194/350 X

FOREIGN PATENT DOCUMENTS

3727927 * 3/1989 (DE) ..... 194/350

OTHER PUBLICATIONS

Zanussi Vending, *PRIMA*, Jan. 1993, pp. 1–2.
Westomatic Vending Services Limited, *Sonata*, Apr. 1995, pp. 1–4.
Stentorfield, *Contour*, Apr. 1998, pp. 1–6.
Stentorfield, *Profile*, Apr. 1998, pp. 1–6.
Automatic Marketing Industries, Inc. *Coffee–Inn's® The Mocha Mart(Model MM–2C)*, undated, pp. 1.
Rhea Vendors, S.p.A., *P.C.M. The racing car for coffee*, undated, pp. 1–4.
Saeco® Vending, *Saeco 10P Plus*, undated, pp. 1–4.
Spengler Getränkemaschinen GmbH, *Office Line*, (English version), undated, pp. 1–2.
Spengler Getränkemaschinen GmbH, *Office Line*, (German version) undated, pp. 1–2.
The Sankey Unicafé, *A New Dimension In Freash Brewed Coffee*, undated, pp. 1–2.
Westomatic Vending Services Limited, *MONACO®*, undated, pp. 1–3.
Zanussi Vending, *Dispenser*, undated, pp. 1–2.

* cited by examiner

*Primary Examiner*—F. J. Bartuska
(74) *Attorney, Agent, or Firm*—Senniger, Powers, Leavitt & Roedel

(57) ABSTRACT

A coin storage and changing mechanism having a front panel with a message screen thereon and coin changing mechanism mounted to telescoping supports that allow the coin changing mechanism and front panel to be moved out of the cabinet. The coin mechanism and front panel are connected by a hinge to the telescoping supports so that the panel can be pivoted to the side adjacent a coin mechanism control panel so that the serviceman can see the control panel and message screen side-by-side. A coin storage tray is provided in the bottom of the cabinet and has an arcuate deflector for receiving coins from the coin mechanism and directing them toward the back of the tray for storage.

4 Claims, 6 Drawing Sheets

COIN STORAGE AND CHANGING MECHANISM

BACKGROUND OF THE INVENTION

The present invention relates to coin changers and, more particularly, those for use in connection with product vending machines.

Coin storage and changing mechanisms are utilized on a large variety of vending machines to facilitate purchase of items from the vending machines. Many of these modules are built into the vending machine cabinet and are accessed by opening the main service door for the entire vending machine. Others are add-on modules that can be bolted or otherwise secured to the side of a vending machine and interfaced with the electronics of the vending machine to allow vending of products. A common problem for all such modules is ease of programming the prices for given selections, the ability to make change for multiple customers who do not have exact change for a selection and sufficient storage space for coins received from customers such that the equipment does not have to be serviced inordinately frequently. Thus, space and ease of programming are two major problems associated with such equipment.

SUMMARY OF THE INVENTION

The present invention overcomes the above-described difficulties and disadvantages associated with prior art coin changing and storage mechanisms, particularly those which are add-on modules, by providing such a system that is both easy to program and provides substantial coin storage space within a small cabinet. These advantages are achieved by providing a coin receiving and changing mechanism for use in a vending machine, comprising a cabinet, a slide out frame mounted for movement into and out of the cabinet, a coin mechanism mounted to the frame for movement into and out of the cabinet and adapted for receiving coins from a customer and providing change, a front panel mounted to the frame for movement towards and away from the cabinet for closing off the front of the cabinet and having a message screen thereon and a coin return tray, a coin mechanism programming control panel mounted to a side of the frame for movement therewith into and out of the cabinet and being interconnected to the message screen for showing programming action on the message screen, and the coin mechanism and front panel being mounted to the frame for pivotal movement from a position for storage in the cabinet to a position where the message screen is substantially parallel to the programming control panel for viewing during the operation of the control panel.

In a further aspect of the coin receiving and changing mechanism of the present invention it preferably includes a coin storage tray removably disposed below the coin mechanism within the cabinet for receiving and storing coins received therefrom. In a further aspect of the present invention, the storage tray is provided with a deflector plate at an end thereof where the coins are received from the coin mechanism such that the coins are received on an edge so as to cause the coins to roll towards an opposite end of the storage tray. Still further, the deflector plate preferably is generally arcuate in cross section and receives the coins on one end of the arch and deposits them from an opposite end of the arch onto an adjacent bottom of the storage tray.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION OF THE PREFERRED EMBODIMENT

Figure 1:
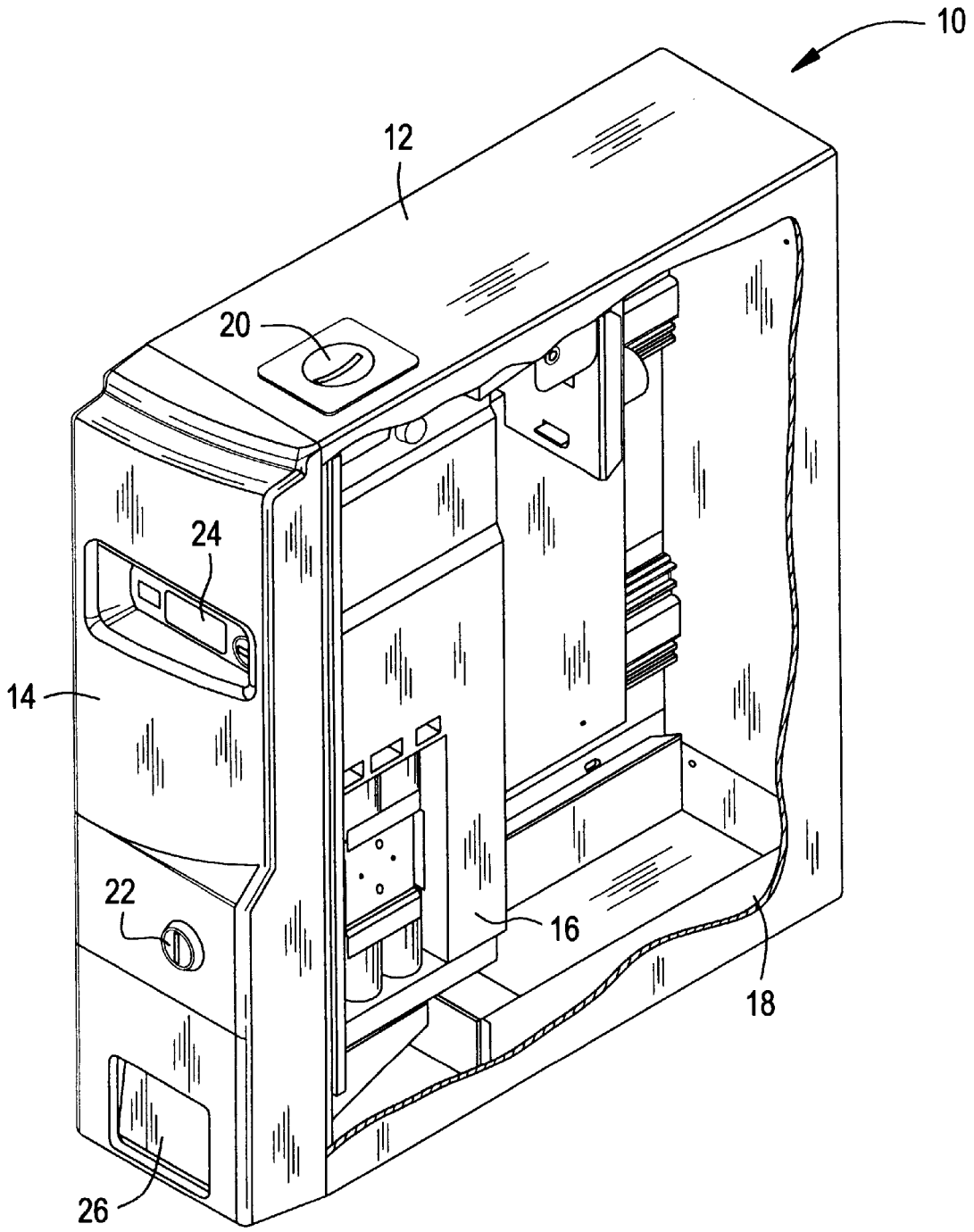
FIG. 1 is a pictorial view from the right side partially cut away of the preferred embodiment of the present invention.

Referring to FIG. 1, the coin changing and storage mechanism of the present invention is identified as numeral 10 which broadly includes a main storage cabinet 12, a front cover panel 14, a coin changing mechanism 16 and a coin storage tray 18. In the top of cabinet 10 is a coin slot 20 where the customer introduces coins for the purchase of an item. The coin changing and storage mechanism 10 is designed for attachment to any one of a plurality of vending machines, such as a table-top vending machine (not shown). The cabinet 12 is designed to be bolted to the side of such a vending machine and is provided with openings through which cables can be passed so that the coin changing and storage mechanism 10 can interact with the vending machine to produce the desired vend once sufficient coinage is introduced and the customer has made his selection from the vending machine control panel. The main communication between the coin changing and storage mechanism 10 of the present invention and such vending machines is for the purpose of sending a signal to initiate a vend once the unit has determined adequate change has been inserted. The vending machine then vends whatever selection the customer made from its control panel.

Front cover panel 14 covers the entire front portion of the cabinet 12 when in its closed position as illustrated in FIG. 1. In this position the front panel 14 can be locked in place such as by a locking mechanism 22 which engages the cabinet interior in a well-known manner in order to prevent the front panel from being pulled away from the opening in the front of the cabinet 12. An electronic message screen 24 is mounted in a recess in the upper portion of front panel 14 to provide information to the customer as to the amount of change inserted, and other information as described below. The front panel 14 is also provided in its lower portion with a coin return tray 26.

Figure 2:
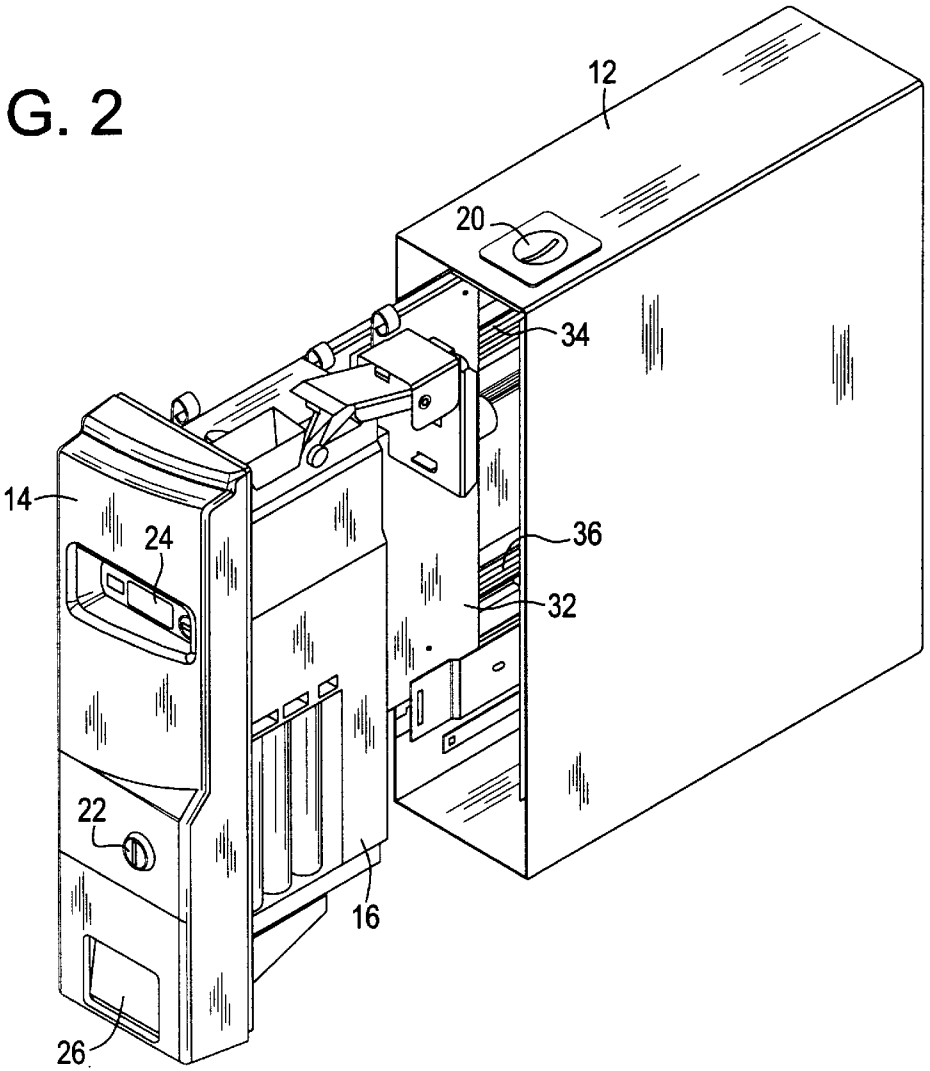
FIG. 2 is a pictorial view from the right side with the front panel and coin mechanism withdrawn from the cabinet.
Figure 3:
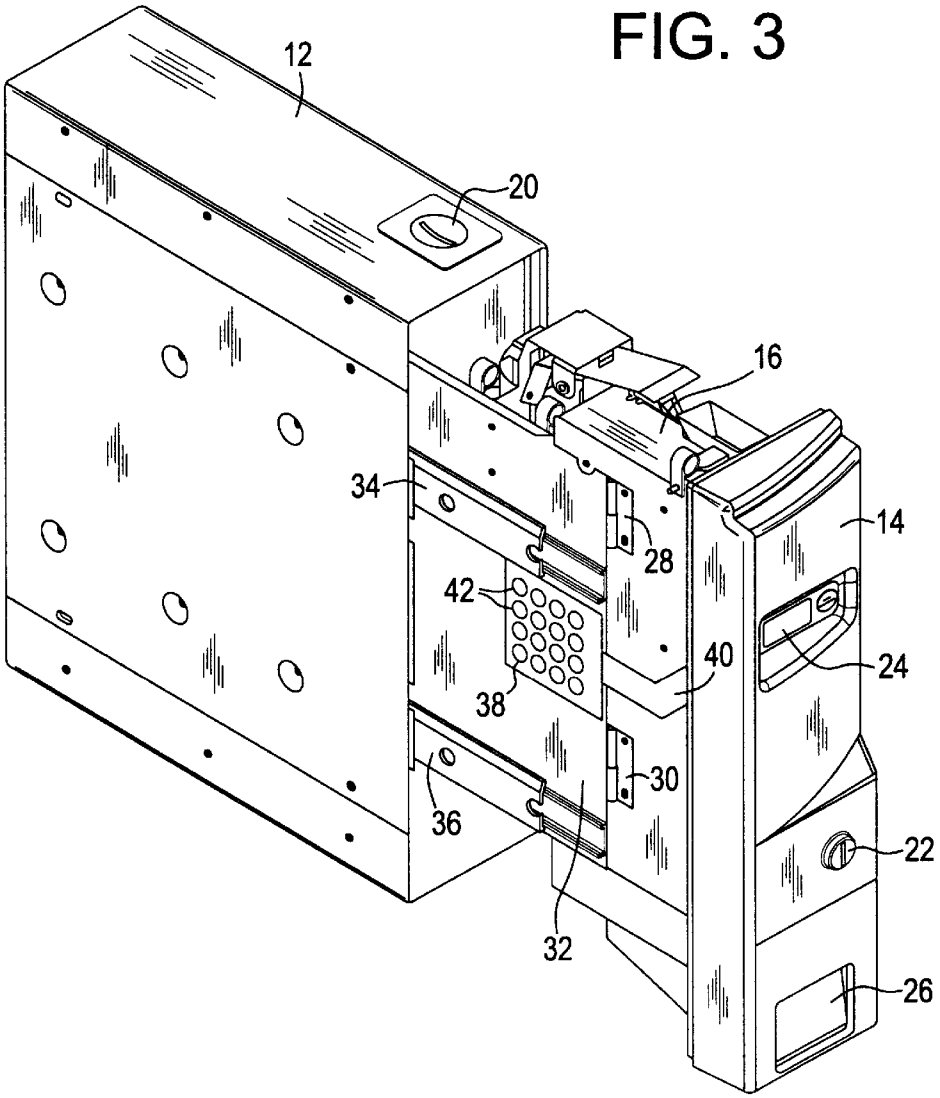
FIG. 3 is a pictorial view from the left side of the preferred embodiment with the coin mechanism and front panel withdrawn from the cabinet.

As best seen in FIGS. 2 and 3, front panel 14 is secured to the front of coin mechanism 16, such as by bolts or the like, and the coin mechanism 16 is, in turn, secured by hinges 28 and 30 to a frame member 32. Frame member 32 is supported by telescoping rails 34 and 36 which allow the frame member 32 and coin mechanism 16 and panel 14 to be slid in and out of cabinet 12. The telescoping rails 34 and 36 permit the entire coin mechanism to be withdrawn from the inside of the cabinet as shown in FIG. 2.

As best seen in FIG. 3, a coin mechanism programming control panel 38 is also mounted to the frame for movement into and out of the cabinet therewith and is connected by ribbon wire 40 to the message screen 24 and the coin mechanism to provide operating control for both and for use by the serviceman for setting prices for vends of a vending machine which would be attached to the coin changing storage mechanism 10 of the present invention. Each of the buttons 42 on the control panel 38 are provided with alpha and/or numeric indicia in a well-known manner and provide the ability to send the necessary signals for programming the coin mechanism operation and displays on the screen 24, all of which is conventional and will therefor not be discussed further herein.

Figure 4:
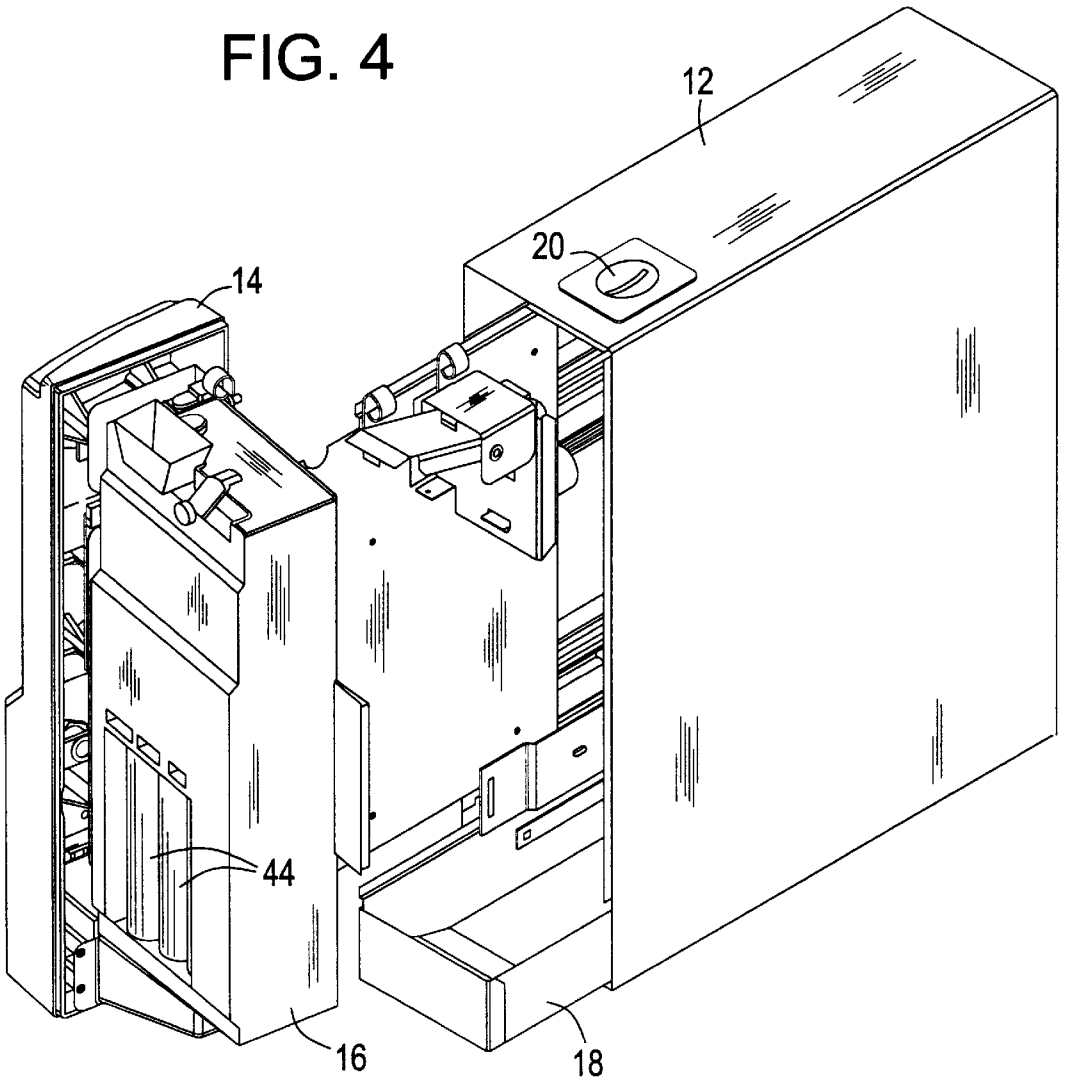
FIG. 4 is a pictorial view of the preferred embodiment with the coin mechanism and front panel pivoted towards the left of the machine and the coin storage box partially withdrawn from the cabinet.
Figure 5:
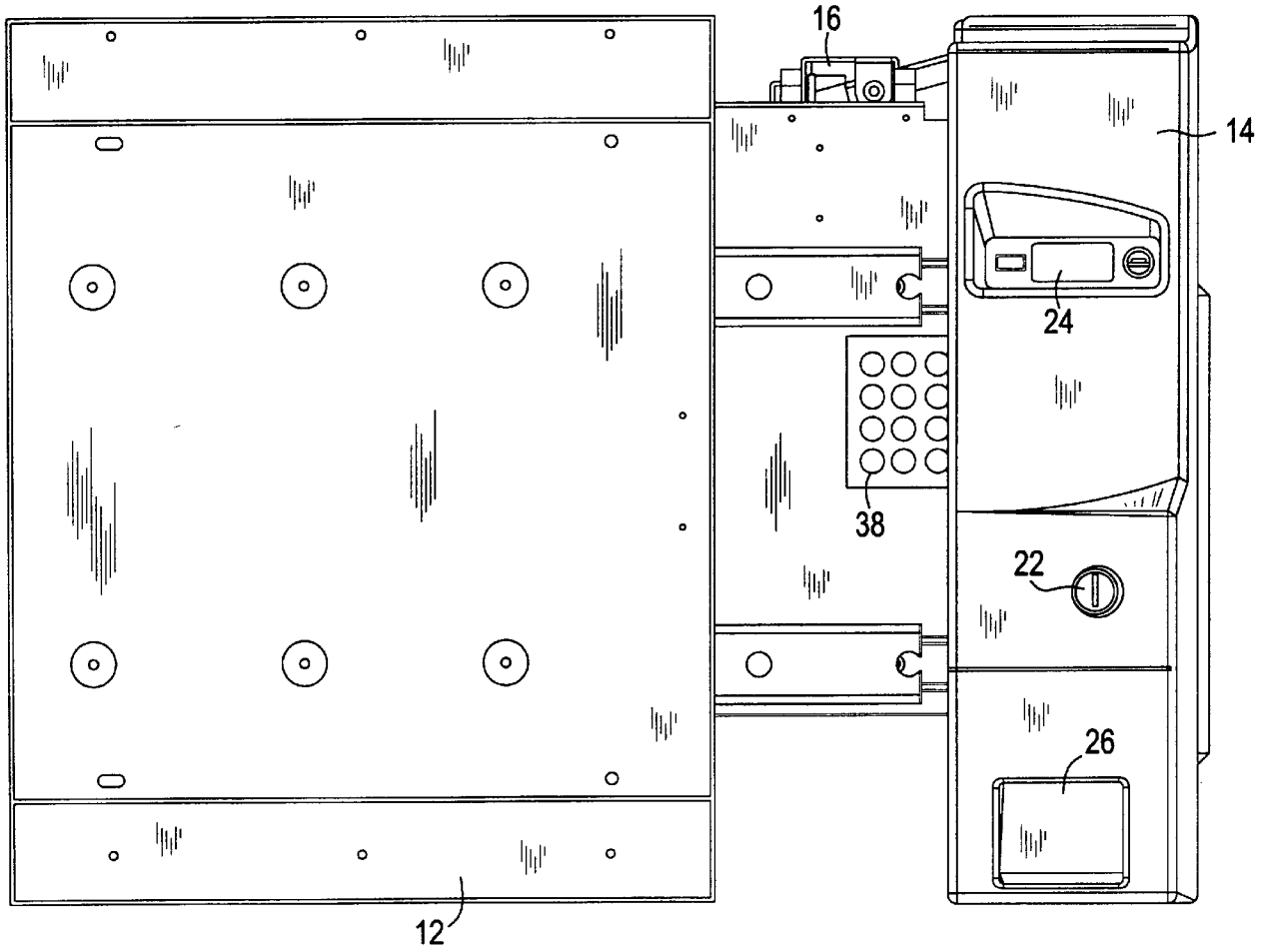
FIG. 5 is a left elevational view of the preferred embodiment with the front panel and coin mechanism withdrawn from the cabinet and pivoted so that the message screen is adjacent and parallel to the programming control panel.

In accordance with one advantage of the present invention and as best seen in FIGS. 4 and 5, the front panel 14 and coin mechanism 16 can be pivoted as illustrated so that the message screen 24 is parallel to the control panel 38 so that as the coin mechanism 16 is being programmed through the control panel 38 by a serviceman, he can see directly the message screen 24 while operating the control panel 38 without having to look around to the front of the cabinet as would be necessary if the front panel 14 and coin mechanism 16 could not be pivoted on hinges 28 and 30 as they are. This location of the message screen makes it much more convenient and error free for the serviceman since he can see both the control panel 38 and message screen 24 without moving. The ability to pivot the coin mechanism 16 as well as the front panel 14 permits easy access to the side of the coin mechanism for filling the coin return tubes, such as tubes 44, and in addition, permits easy removal of coin storage tray 18 from beneath and behind the coin mechanism 16 where it is stored when it is in its normal position within the cabinet 12.

Figure 6:
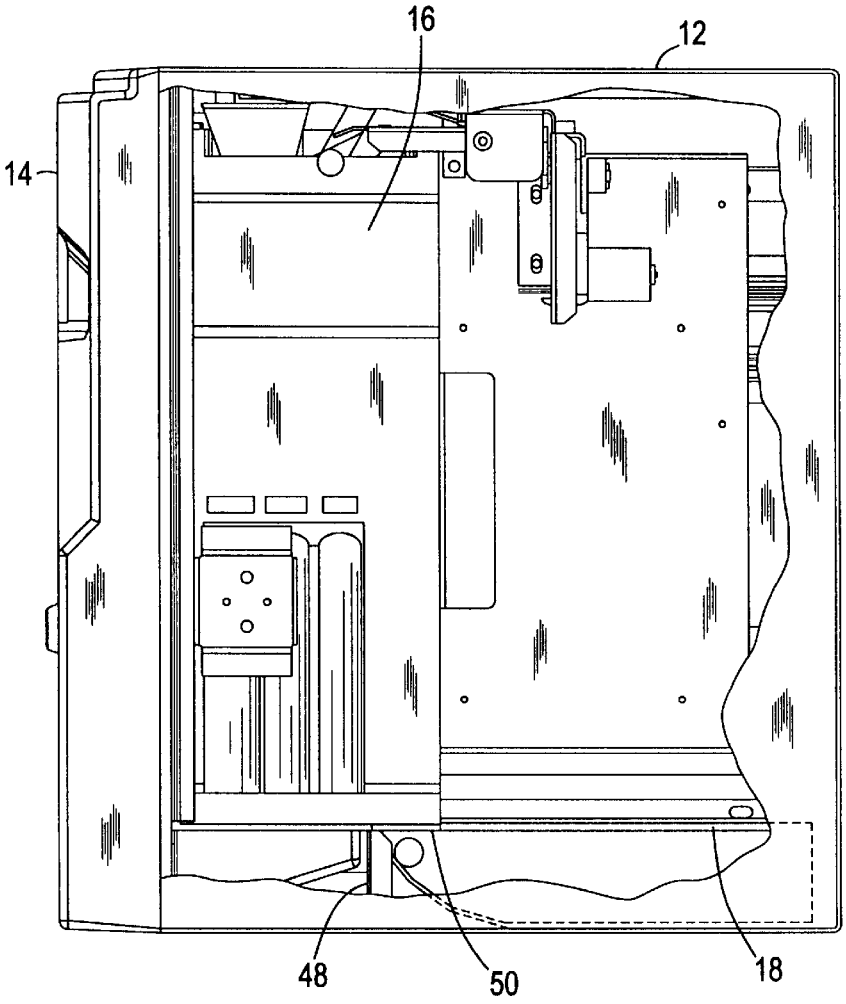
FIG. 6 is a right side elevational view partially cut away showing the position of the coin mechanism over the coin storage tray.
Figure 7:
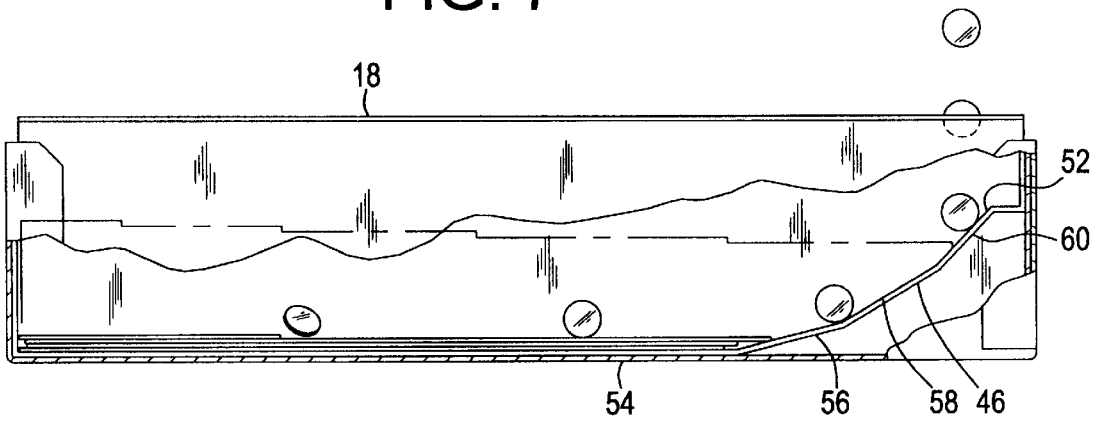
FIG. 7 is a partial cross sectional view and partially cut away side view of the coin storage tray illustrating the movement of coins therein received from the coin mechanism.

The coin storage tray 18, as best seen in FIGS. 6 and 7, is a rectangular tray provided with a generally arcuate in cross-section coin deflector plate 46 which extends across the end 48 thereof adjacent the outlet chute 50 for coins coming from the coin mechanism 16. As illustrated, coins coming from the outlet chute 50 of the conventional coin mechanism 16 are directed towards the upper end 52 of deflector plate 46 and then rolled down the deflector plate 46 towards the bottom 54 of tray 18 where they roll along until they fall over and then accumulate on the bottom of the tray in a relatively level stack across the entire width of the tray 18 and continue to accumulate in this manner over most of the bottom of the tray and fill up the tray as additional coins are added. Deflector plate 46 is illustrated in FIG. 7 as actually being three straight segments 56, 58 and 60 which are joined at bends to produce the generally arcuate shape desired. This shape is chosen for manufacturing purposes, but could easily be a continuous arcuate shape or have more bends and shorter straight segments so long as it achieves the desired result of receiving the coins at the upper end of the generally arched surface directing them in a rolling manner as shown towards the bottom surface and any built-up layer of coins so that the coins will roll along the surface and generally progress more towards the rear of the tray. This achieves a much greater capacity for a try than merely allowing the coins to fall from the chute 50 in to a flat bottomed tray where they tend to produce a pile directly beneath the chute 50 and leave much of the tray unused.

In view of the above, it will be seen that the several objects of the invention are achieved and other advantageous results attained.

As various changes could be made in the above constructions, without departing from the scope of the invention, it is intended that all matter contained in the above description and shown in the accompanying drawings shall be interpreted as illustrative and not in a limiting sense.

What is claimed is:

1. A coin receiving and changing mechanism for use in a vending machine, comprising:

a cabinet;

a slide-out frame mounted for movement into and out of the cabinet;

a coin mechanism mounted to said frame for movement into and out of the cabinet and adapted for receiving coin from a customer and providing change;

a front panel mounted to the frame for movement towards and away from the cabinet for closing off the front of the cabinet and having a message screen thereon and a coin return tray;

a coin mechanism programing control panel mounted to a side of the frame for movement therewith into and out of the cabinet and being interconnected to the message screen for showing programming action on the message screen;

the coin mechanism and front panel being mounted to the frame for pivotal movement from a position for storage in the cabinet to a position where the message screen is substantially parallel to the programming control panel for viewing during operation of the control panel.

2. The coin receiving and changing mechanism of claim 1 including a coin storage tray removably disposed below the coin mechanism within the cabinet for receiving and storing coins received therefrom.

3. The coin receiving and changing mechanism of claim 2 wherein the storage tray is provided with a deflector plate at an end thereof where the coins are received from the coin mechanism such that the coins are received on an edge so as to cause the coins to roll toward an opposite end of the storage tray.

4. The coin receiving and changing mechanism of claim 3 wherein the deflector plate is generally arcuate in cross section and receives the coins on one end of the arch and deposits them from an opposite end of the arch onto an adjacent bottom of the storage tray.

* * * * *